US010952482B2

(12) United States Patent
Plon

(10) Patent No.: US 10,952,482 B2
(45) Date of Patent: Mar. 23, 2021

(54) SECURABLE HAT

(71) Applicant: Richard Stanley Plon, Irvine, CA (US)

(72) Inventor: Richard Stanley Plon, Irvine, CA (US)

( * ) Notice: Subject to any disclaimer, the term of this patent is extended or adjusted under 35 U.S.C. 154(b) by 40 days.

(21) Appl. No.: 16/568,754

(22) Filed: Sep. 12, 2019

(65) Prior Publication Data

US 2020/0068973 A1 Mar. 5, 2020

Related U.S. Application Data

(62) Division of application No. 14/806,377, filed on Jul. 22, 2015, now abandoned.

(51) Int. Cl.

| | |
|---|---|
| ***A42B 1/02*** | (2006.01) |
| ***A42B 1/24*** | (2021.01) |
| ***A42B 7/00*** | (2006.01) |

(52) U.S. Cl.

CPC ..... *A42B 1/02* (2013.01); *A42B 1/24* (2013.01); *A42B 7/00* (2013.01)

(58) Field of Classification Search

CPC ..... A42B 1/006; A42B 1/02; A42B 1/245; A42B 1/12; A42B 1/069; A42B 1/008; A42B 1/04; A45F 3/00; A45F 3/02

USPC ..... 2/209.13, 209.11, 171.3, 171, 6

See application file for complete search history.

(56) References Cited

U.S. PATENT DOCUMENTS

| | | | | |
|---|---|---|---|---|
| 1,414,797 A | | 5/1922 | Trau | |
| 2,710,639 A | * | 6/1955 | Farls | A45F 3/00 383/26 |
| 2,771,230 A | | 11/1956 | Fitzpatrick | |
| 4,201,009 A | * | 5/1980 | Burridge, Jr. | A42B 1/006 2/175.1 |
| 4,556,993 A | | 12/1985 | Okamura, Sr. | |
| 4,932,574 A | | 6/1990 | Doshi | |
| 5,092,681 A | * | 3/1992 | Ashley, III | B65D 33/28 383/4 |
| 5,214,802 A | * | 6/1993 | McCallum | A42B 1/006 2/209.12 |
| 5,367,713 A | * | 11/1994 | McCallum | A42B 1/006 190/1 |
| D366,352 S | * | 1/1996 | Shoemaker | D2/874 |

(Continued)

FOREIGN PATENT DOCUMENTS

| | | |
|---|---|---|
| FR | 2741241 A1 | 5/1997 |
| JP | 3139676 U | 2/2008 |

(Continued)

OTHER PUBLICATIONS

Australian Examiniation report application No. 2016295313, dated Mar. 6, 2020.

(Continued)

*Primary Examiner* — Jillian K Pierorazio

(74) *Attorney, Agent, or Firm* — Carlos A. Fisher; Stout, Uxa & Buyan, LLP

(57) ABSTRACT

The present invention provides hats with attachment assemblies allowing them to be detachably secured in an exterior-side out configuration to a belt of medium width worn around the wearer's waist, without requiring the hats to be inverted, reversed, or folded in a complex fashion, and without any need for pockets, linings, zippers or the like. The hats may also be provided with retention members for holding the hats in a simple folded configuration when carried on a belt.

5 Claims, 7 Drawing Sheets

(56) References Cited

U.S. PATENT DOCUMENTS

| | | | | |
|---|---|---|---|---|
| 5,511,705 | A | 4/1996 | Dreszer | |
| 5,799,335 | A * | 9/1998 | Ethier | A42B 1/006 150/100 |
| 5,890,638 | A | 4/1999 | Woloshen | |
| 6,167,569 | B1 * | 1/2001 | Conner, IV | A42B 1/006 2/195.1 |
| 6,230,331 | B1 | 5/2001 | Aguilar et al. | |
| 6,237,159 | B1 * | 5/2001 | Martin | A42B 1/247 2/13 |
| 6,317,892 | B1 | 11/2001 | Gagliani | |
| 6,484,323 | B1 * | 11/2002 | Pu | A42B 1/201 2/10 |
| D483,927 | S * | 12/2003 | Appleberry | D2/882 |
| 6,679,405 | B2 * | 1/2004 | Zalis-Hecker | A45C 1/04 150/107 |
| D496,146 | S * | 9/2004 | Appleberry | D2/876 |
| 6,877,168 | B1 | 4/2005 | Duffy et al. | |
| 7,011,241 | B2 | 3/2006 | Godshaw et al. | |
| 7,036,155 | B2 | 5/2006 | Rugg | |
| 7,257,845 | B1 * | 8/2007 | Conner, IV | A42B 1/006 2/209.12 |
| D572,437 | S * | 7/2008 | Scott | D2/882 |
| 7,556,374 | B1 | 7/2009 | Cooper | |
| 7,774,863 | B2 * | 8/2010 | Garza | A42B 1/006 2/209.11 |
| 7,938,533 | B2 | 5/2011 | Shapiro | |
| 8,267,289 | B2 | 9/2012 | Irvin | |
| D791,447 | S * | 7/2017 | Thornton | A42B 1/206 D2/881 |
| 2004/0210982 | A1 | 10/2004 | Kronenbeger | |
| 2005/0128430 | A1 | 6/2005 | Uren | |
| 2006/0048279 | A1 | 3/2006 | Bartos | |
| 2006/0273129 | A1 | 12/2006 | Horn | |
| 2007/0087794 | A1 | 4/2007 | Choi | |
| 2008/0201821 | A1 | 8/2008 | Bryant | |
| 2010/0212066 | A1 | 8/2010 | Gilman | |
| 2012/0096626 | A1 | 4/2012 | Edwards | |
| 2013/0191965 | A1 * | 8/2013 | Edwards | A42B 1/24 2/209.13 |
| 2014/0047617 | A1 | 2/2014 | Abers | |
| 2014/0230129 | A1 | 8/2014 | Viviani | |
| 2014/0263494 | A1 | 9/2014 | Treska | |
| 2014/0320798 | A1 | 10/2014 | Tribelhorn | |
| 2015/0115008 | A1 | 4/2015 | Griffith | |
| 2017/0020220 | A1 | 1/2017 | Plon | |

FOREIGN PATENT DOCUMENTS

| | | | |
|---|---|---|---|
| KR | 200311535 | Y1 | 5/2003 |
| NL | 1024962 | C1 | 6/2005 |
| WO | 8303527 | A1 | 10/1983 |

OTHER PUBLICATIONS

International Search Report, application No. PCT/US18/48723, dated Dec. 18, 2018.

European Search Report (extended) application No. PCT/US2016040955, dated Feb. 2, 2019.

Patent Search Report, Cardinal Intellectual Property, report date Apr. 21, 2015.

www.wellpromo.com, Wholesale-Fold N' Go Fisher Hat dated Apr. 20, 2015.

www.amazon.com, Twist-and-Fold Hat Women's Foldable Cotton Sun Hat, 18 in diameter brim, dated Apr. 20, 2015.

www.sagemember.com, Folding Fisher Hat, dated Apr. 20, 2015.

www.amazon.com Rfid Travel Wallet, dated Apr. 20, 2015.

www.jamminleather.com, Black Leather Clip-On Pouch w/Key Ring, dated Apr. 20, 2015.

International Search Report, application No. PCT/US2016/040955, dated Nov. 3, 2016.

* cited by examiner

SECURABLE HAT

CROSS-REFERENCE TO RELATED APPLICATIONS

This application is a divisional of U.S. patent application Ser. No. 14/806,377, filed Jul. 22, 2015, which is hereby incorporated by reference herein in its entirety.

FIELD OF THE INVENTION

The present invention relates to hats and, in particular, to hats that can be secured to articles of clothing. More specifically, the invention relates to hats that can be secured to the body for storage; in preferred examples the hats of the present invention are structured to be secured to a belt worn on the person, for example, around an individual's waist.

BACKGROUND

Hats are a valuable defense against the sun and inclement weather. Available in a wide variety of shapes, sizes, and styles, they may shield the wearer's eyes from glare, may protect the head from excessive heat and cold, and may reduce the risk of skin cancer. However, a perennial question remains concerning how and where one is to store or carry a hat that is not currently being worn; for example, when the wearer is indoors or at nighttime. Hats are constantly lost or misplaced as a result of their owners simply forgetting where they set them down or left them, or when a hat slips onto the floor unnoticed.

U.S. Pat. No. 5,799,335 to Ethier and U.S. Pat. No. 7,257,845 to Conner disclose convertible hats that can be reassembled into handbags, shoulder bags, satchels, fanny packs or the like. However, each of these hat designs is somewhat complicated and requires that the hat be folded, collapsed, turned inside out, or otherwise inverted in a way that would not be intuitive or convenient to most users. Furthermore, although Ethier and Conner disclose embodiments in which the hat may be converted in form, for example, to a fanny pack or a self-containing bag or other container, and worn joined to an elastic cord or strap that is incorporated as part of the convertible hat for use in one or more of these other, "non-hat" forms. Furthermore, none of these convertible hats is structured and designed to be fastened to a separate, medium-width belt of the type normally worn with slacks, jeans or similar casual clothing.

U.S. Pat. No. 6,317,892 to Galigani, U.S. Pat. No. 7,036,155 to Rugg, U.S. Pat. No. 6,320,331 to Aguilar et al., and international patent application US20060048279 by Bartos, all show hats provided with hard fasteners such as clasps, clips, or rings for attachment to a belt. These rigid fasteners can be problematic, however, in that their hardness makes them uncomfortable if they rub against the user's head. They also may be somewhat costly, prone to breakage, bulky, and easily lost.

Accordingly, there is a long-felt need for hats that can easily be secured to belts of a wide variety of width in a simple and intuitive fashion, are inexpensive to manufacture, and do not require separate extra parts.

SUMMARY

The present invention provides hats with attachment assemblies allowing them to be detachably secured, for example, in an "exterior-side out" configuration; that is, a normal configuration as the hat is to be worn. The attachment assembly is configured to be joined to a standard belt worn around the wearer's waist, preferably without requiring the hats to be inverted, reversed, or folded in a complex fashion, and without the need for pockets, linings, zippers, bags, or the like.

In its simplest, most basic form, a hat according to the present invention may comprise a crown portion, an optional brim portion, and an attachment assembly including at least one strip of suitably flexible material, for example, a fabric material, a leather material, a polymeric material and/or an elastomeric material, having at least one of a first end and a second end attached to the exterior side of the crown portion, with the unattached end, if any, being attachable by any suitable fastener (such as, without limitation, a snap fastener, a button fastener, and/or a hook and loop VELCRO®-type fastener). Preferably, but not necessarily always, the first and/or second ends and any fasteners are arranged to permit the ends of the strip to be attached to the exterior side of the crown portion along a substantially vertical axis relative to the orientation of the hat while it is being worn. A substantially vertical axis shall mean an axis within about 45° of the vertical. The strip is of sufficient length, preferably at least about 1.25", or at least about 1.50", or at least about 1.75" in length, to enable an ordinary belt of at least medium width to be extended through it.

In one example, a single strip is provided, in the form of a length of material that is joined (e.g., by sewing) and/or fastened (i.e., by a suitable fastener) to the exterior of the hat crown in such a way as to define a loop. In another exemplary example, the strip is defined in the form of material located between two closely spaced, similarly oriented slits in the crown portion material. In this latter example, the first end and second end of the strip are joined to and continuous with the material of the crown portion. In some examples, the attachment assembly may be joined to the brim portion. Additionally and independently, however the attachment assembly may otherwise be configured, the attachment assembly may in a particular case comprise a plurality of strips, such as two, three, four or more strips.

As disclosed above, in some examples, one end of the strip is detachably fastened to the crown portion, so that the loop can easily be opened up, wrapped around the wearer's belt, and then fastened, without requiring the user to unfasten the belt from around his or her body or fold the hat into another form. In other examples, the attachment assembly may be joined to the brim portion of a hat.

In addition, in some examples, the hat is formed of sufficiently flexible material to allow it to be folded, for example, in one or more pleat when the hat is attached to a belt using the attachment a assembly. Optionally, the hat may also have at least one retention member comprising one or more suitable fastener for holding the hat in a folded position when secured to the belt.

In certain examples, the securable hat of the present invention may be affixed to a belt, for example, in an inverted fashion, to provide a convenient carrying pouch for keys, cell phone and other items.

BRIEF DESCRIPTION OF THE DRAWINGS

Additional aspects and examples of the present invention will become evident upon reviewing the non-limiting examples described in the specification and the claims, which may be taken in conjunction with the accompanying figures. Herein, like numerals in the drawings and specification designate like elements, and:

DETAILED DESCRIPTION OF THE INVENTION

Figure 1:
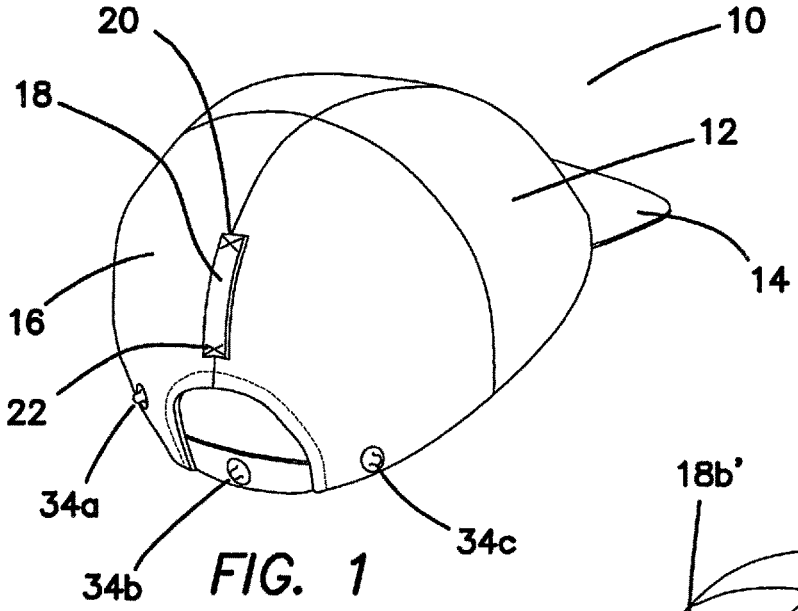
FIG. 1 is a ¾ perspective view from the rear of an example of the invention.

In accordance with a first exemplary embodiment of the invention, FIG. 1 shows a cap 10 having a generally dome-shaped crown portion 12 configured to engage a wearer's head, and a brim portion 14, (here a visor or bill), that projects outwardly from a forward portion of the cap. It will be understood that in some examples of the invention the brim portion may be absent, or may partially or wholly extend around the crown portion. An attachment assembly 16 is provided for attachment of the hat to a belt on the wearer's waist.

In the example shown in FIG. 1, the attachment assembly comprises a single strip 18 of material, such as a denim or canvas fabric. First and second ends (20, 22) of the strip 18 are joined to the eternal back portion of the crown in such a way that the strip 18 and the underlying portion of the crown together define a loop through which the end of medium-width belt may be passed. In this example the opposite ends 20, 22 of the strip 18 are sewn to the crown 12. It will be understood that any appropriate means of joining the strip ends 20, 22 to the crown portion 12 of the hat, such as sewing or riveting, may be employed.

Figure 2:
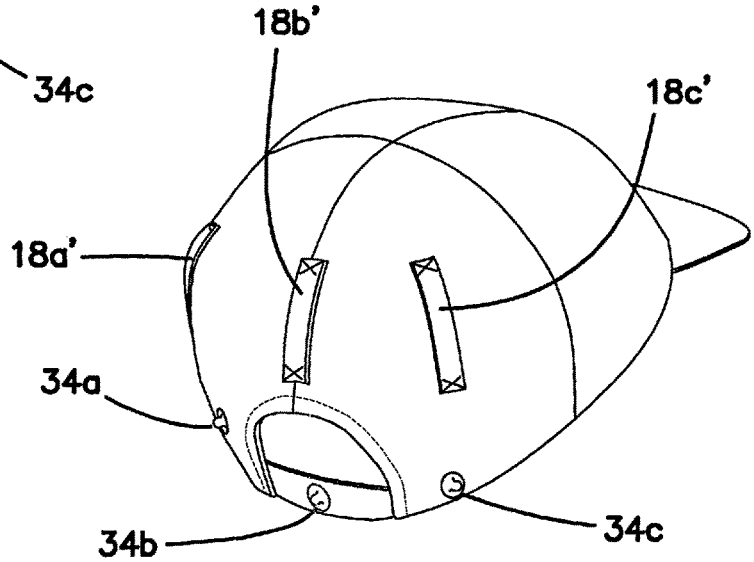
FIGS. 2-4 are fragmentary ¾ perspective views from the rear, showing alternate examples of the invention.

In an alternate example shown in FIG. 2, the attachment assembly 16' comprises a plurality of strips 18*a*', 18*b*', and 18*c*' joined to the hat at closely spaced intervals from one another. The spacing between strips is preferably no more than about 1"-3" or so; thus, for example allowing the hat to be gathered into pleat folds when attached to a wearer's belt.

Figure 3:
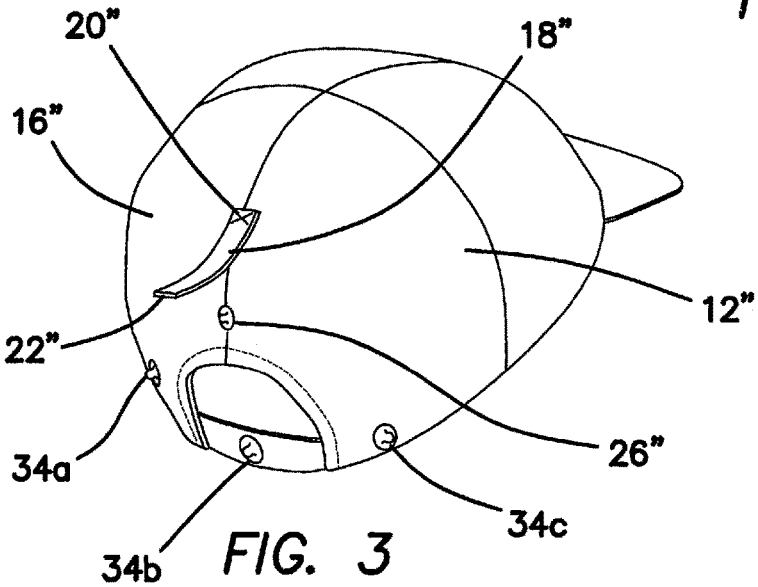

FIG. 3 shows another exemplary embodiment wherein the attachment assembly 16" comprises a flexible strip 18" having a first end 20" sewn to the crown portion 12" and a second end 22" fastened to the crown by means of a releasable connection between a first fastener element (not shown) on the second end 22" and a second fastener element 26" on the crown portion 12". The second fastener element 26" is shown here as a male snap fastener; the first fastener element is in this case a female fastener element. However, other releasable fastener elements such as buttons, hook and loop type fasteners and the like, are also suitable for use in attachment assemblies of this type. Of course, the hat may comprise two or more such strips suitably oriented to all be joined to a single belt in other examples.

A useful feature of attachment assemblies such as those shown in FIG. 3 and described above is that the hat may advantageously be joined to the user's belt without taking the belt off by looping the strip around the belt and fastening the first and second fastener elements of each strip component.

Figure 4:
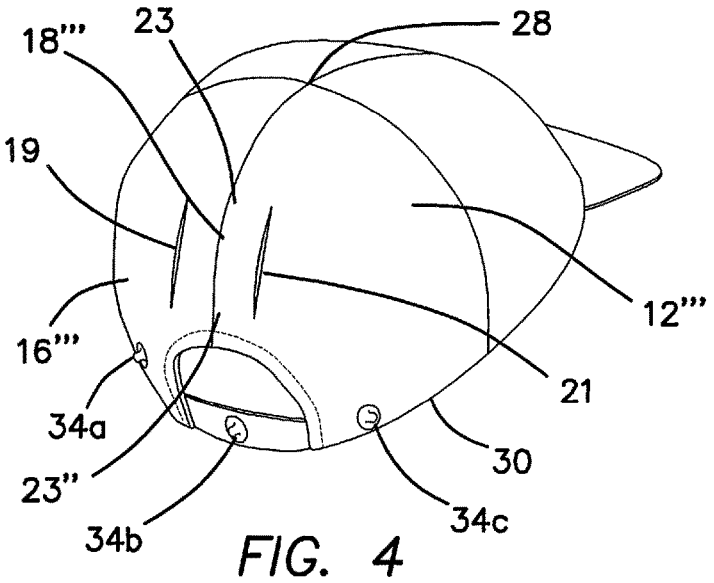

FIG. 4 shows still another example, wherein the attachment assembly 16''' comprises a strip 18''' which is defined as an integral portion of the crown portion 12''' disposed between a pair of closely spaced-apart slits 19, 21. In this example, the user secures the cap to the belt by inserting the free end of the belt into one of the slits 19, passing it under the strip 18''', and then pulling it out through the other slit 21 before buckling or otherwise fastening the belt.

The strip or strips 18 in each of the examples shown FIGS. 1-4 preferably extends in a substantially radial and vertical orientation toward the apex 28 of the hat 10.

That is, the strip should extend at an angle of no more than about 45° away from a straight line extending between the bottom edge 30 and the apex 28 of the hat 10. In this way, a hat, particularly a soft, foldable hat, may be oriented when worn on a belt in a manner permitting the hat to take up less bulk room on the belt than it might otherwise do.

Figure 5:
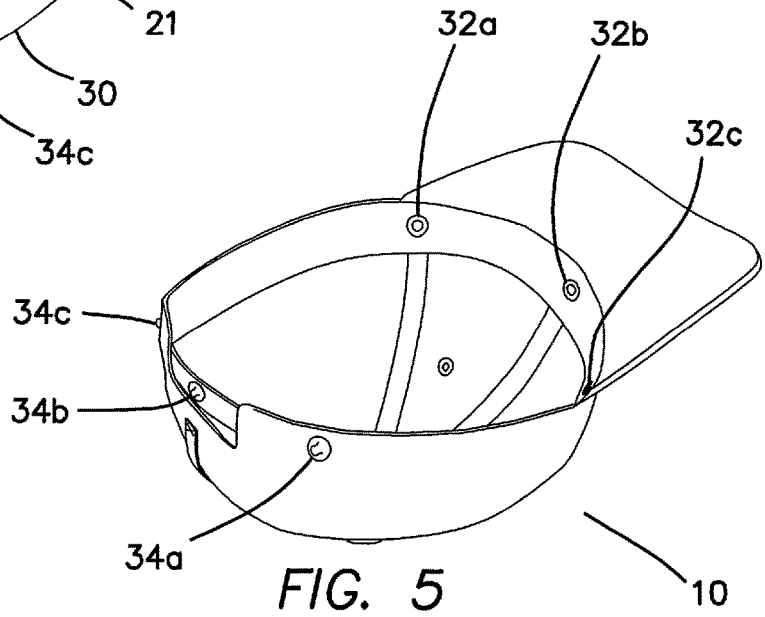
FIG. 5 is a fragmentary perspective view showing a hat according to any one of FIGS. 1-4 in an inverted position.
Figure 6:
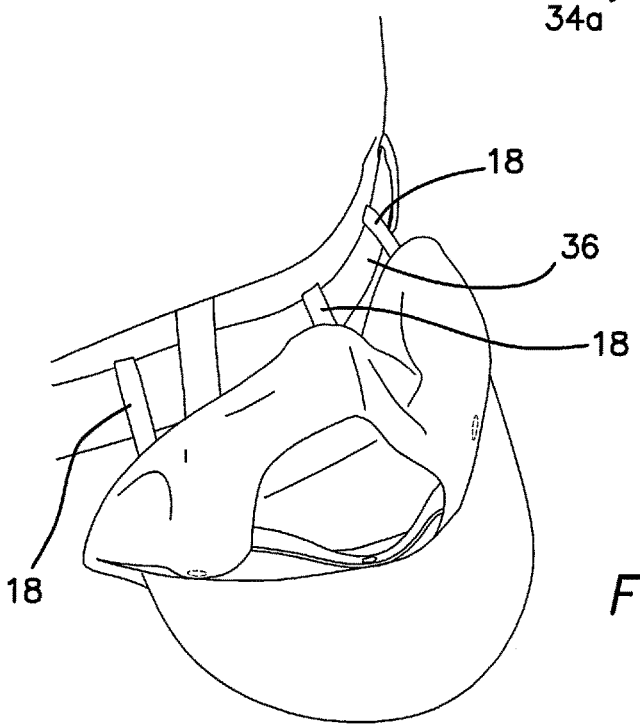
FIG. 6 is a fragmentary perspective view showing the hat of FIG. 1 being worn in a folded configuration on the belt of a user.

In an optional configuration, FIG. 5 shows an example in which the hat is a flexible cap; in this view the hat 10 in an inverted position so that its interior surface 32 is visible, revealing a plurality of fastener members mounted along the interior front edge of the hat 10. These fastener members, shown here as female snap fastener elements 32*a*, 32*b*, and 32*c*, are configured to releasably engage mating male snap fastener elements 34*a*, 34*b*, 34*c* mounted along the exterior rear edge of the hat 10 (see FIG. 1), to maintain the hat 10 in a folded position when it has been secured on the wearer's belt, as shown in FIG. 5. In this and similar configurations, the fastener members permit the cap to folded over itself to form a pocket (see e.g., FIG. 6). Thus, in this folded position, the hat 10 may also serve as a convenient receptacle for containing an item such as a cell phone 38 (see e.g., FIG. 8), wallet, car keys or the like.

The flexible strips 18 in each of the examples shown in FIGS. 1-6 are preferably long enough, and the positions at which they are joined to the crown portion of the hat sufficiently widely spaced, to provide adequate clearance for a belt 36 of at least medium width, where the width of the belt is defined as the dimension extending transverse to the length or longitude of the belt. At present, a medium width belt is a recognized to be at least 1¼" wide, with at least ½" clearance required to allow the belt 36 to be easily slipped through loops defined by the strips 18. Thus, each strip 18 should preferably be at least about 1.25", or at least about 1.50", or at least about 1.75" inch.

Figure 7:
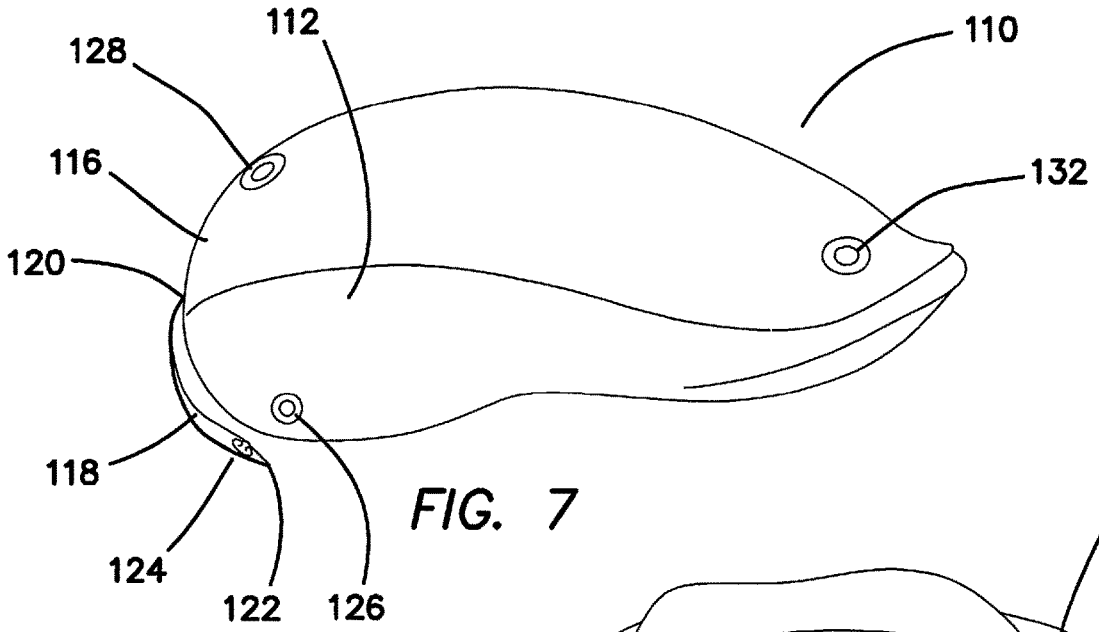
FIG. 7 is a ¾ perspective view from the rear of another exemplary embodiment of the invention.
Figure 8:
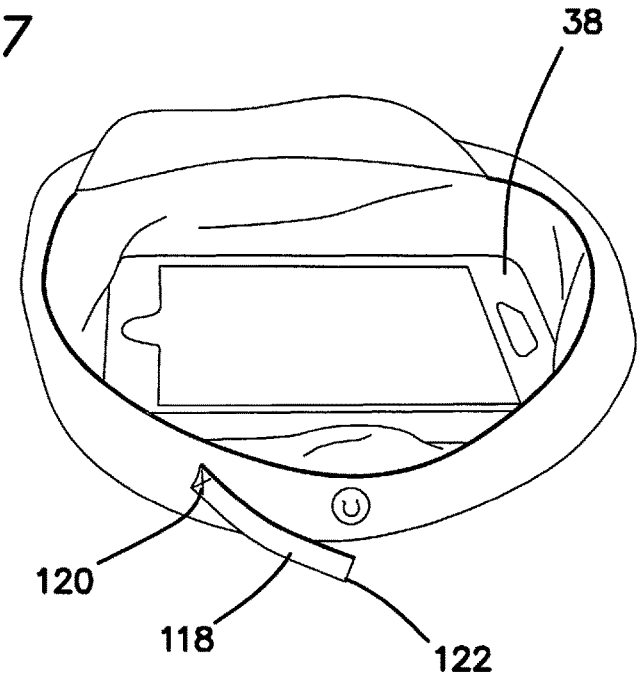
FIG. 8 is a perspective view showing the hat of FIG. 7 in an inverted position, with an item stored within.

FIGS. 7 and 8 show an alternate example of the hat 110, wherein the attachment assembly 116 comprises a flexible strip 118 that extends in a generally circumferential direction along the bottom rear edge of the crown of the hat 110. One end 120 of the strip 118 is sewn or otherwise permanently secured to the crown, while the other end 122 is provided with a first element of a releasable fastener member such as a male snap fastener element 124 that mates with a second fastener element of a releasable connection such as female snap fastener element 126 provided on the edge of the crown 112, preferably at a distance of at least about 1", or at least about 1.5", or at least about 2" away from the first end 120 of the strip 118. This arrangement serves to hold the strip 118 in place when the hat 110 is being worn on the user's head. However, when the hat 110 is removed from the wearer's head, the second end 122 of the strip 118 may be releasably secured to a third fastener element of a releasable connection such as female snap fastener element 128, which is provide on the rear portion of the hat, thus defining a loop which permits the hat to be attached to a belt when not in use.

Alternatively, the hat of FIG. 7 may be folded in two and the first fastener element 124 (in this case, a male fastening element) attached to a fourth fastening element 132 (in this case, female) provided on the exterior front portion of the crown or brim portion 112. This allows the hat 110 to be folded in two, forming a convenient receptacle for containing a cell phone 138 or the like.

As in the embodiment of FIGS. 1-6, the strip 118 is preferably at least about 1.25", or at least about 1.50", or at least about 1.75" inch, to enable it to form a loop with sufficient clearance to receive a belt of at least medium width. Furthermore, the strip should be form of sufficiently flexible material to enable it to be easily twisted from a generally circumferential orientation allowing the second end of the strip 118 to be secured to the second connection element 126 to a generally radial orientation allowing the second end of the strip to be secured to the third fastener element 128.

Figure 9A:
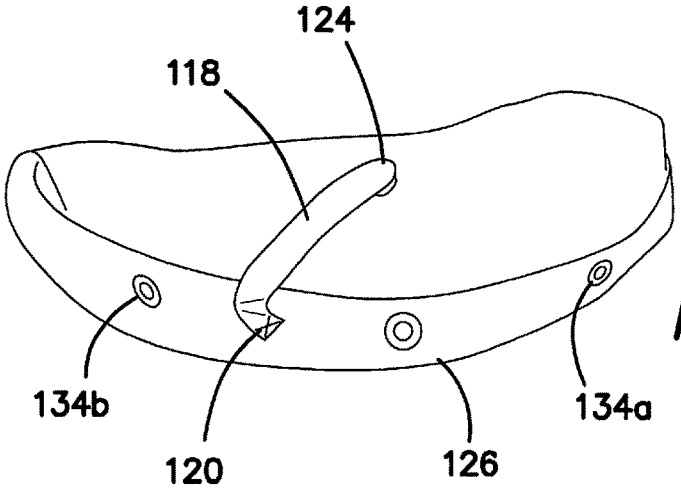
FIG. 9A is a perspective view of the hat of FIGS. 7 and 8 in a folded configuration.
Figure 9B:
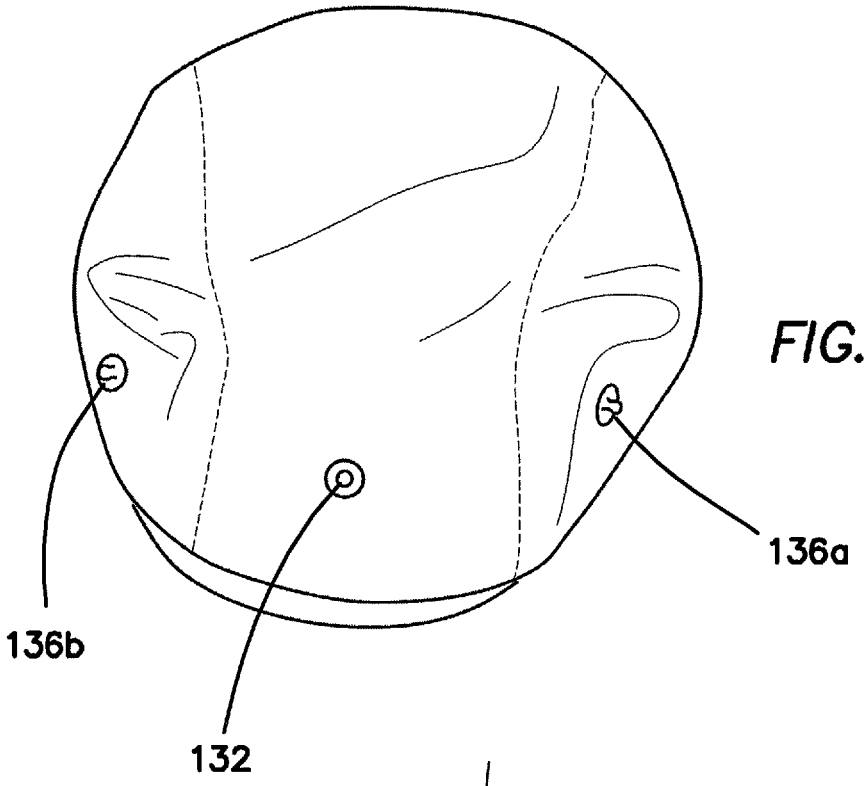
FIG. 9B is a top view of the hat of FIG. 9A in an unfolded configuration.

Turning now to FIGS. 9A and 9B, an alternative example of a flat cap is depicted. In this case, the attachment assembly is substantially similar to that shown on FIG. 7. However, fastener elements 134*a* and 134*b* (in this case female snap fastener elements) are present along the lower rear edge of the crown of the hat, and configured to be removably joined to complementary fastener elements 136*a* and 136*b* on the outer brim portion of the hat. In this way, the hat can be folded over as shown in FIG. 9A, with the send end 124 of the strip 118 joined to female fastener element 132 to create a loop for fastening the folded hat to a waist belt. The additional fastener elements help create a more secure pouch or pocket in which items may be carried while the hat is folded.

Figure 10:
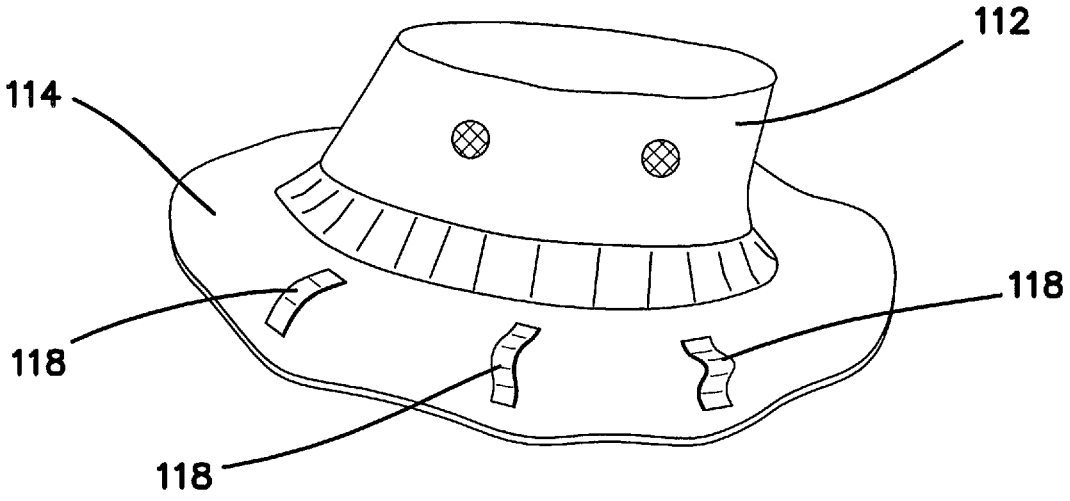
FIG. 10 is a side view of a "bucket"-style cloth hat of the present invention, showing an exemplary attachment assembly.

FIG. 10 shows a "bucket"-style cloth hat of the present invention, showing an exemplary attachment assembly. In this example, the attachment assembly comprises three cloth strips 118, with each strip having a first end 120 and second end 124 attached to the brim portion 114 thereof.

Figure 11:
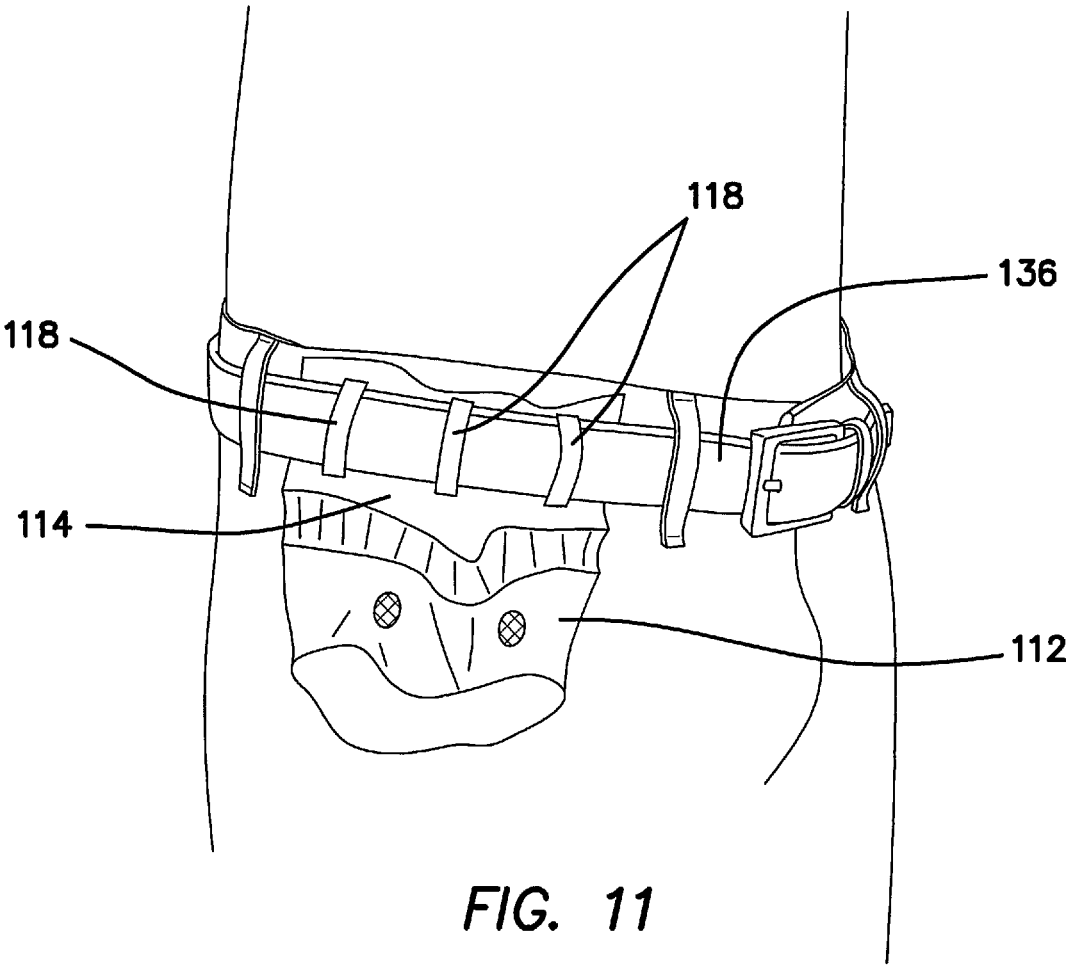
FIG. 11 is a view of the hat of FIG. 10 attached to a wearer's belt by the attachment assembly.

FIG. 11 shows the bucket-style hat of FIG. 10 attached to a waist belt 36 with the attachment assembly comprising strips 118.

Figure 12:
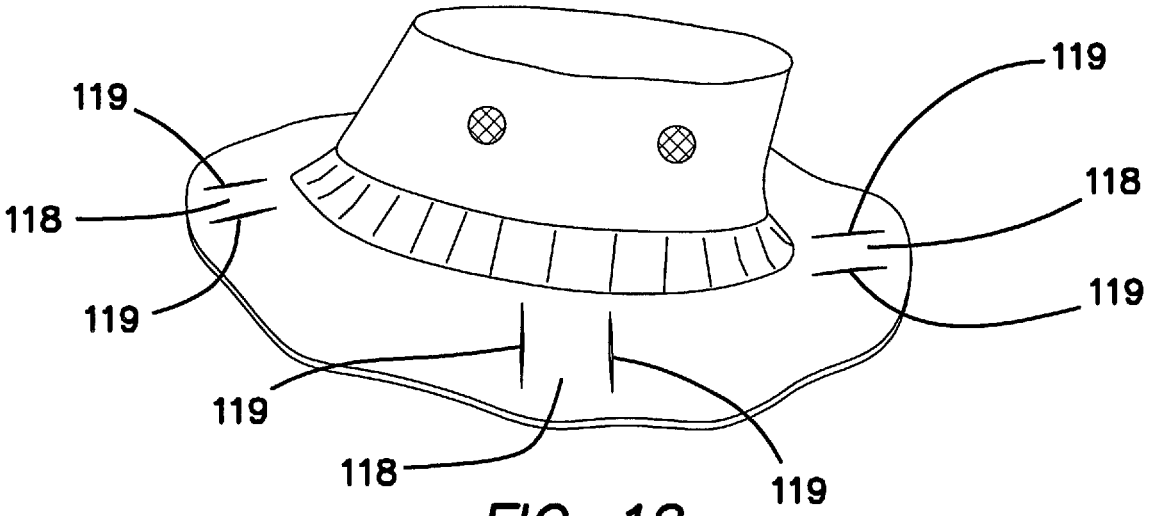
FIG. 12 is a side view of a "bucket"-style cloth hat of the present invention, showing an exemplary attachment assembly.

FIG. 12 shows a "bucket"-style cloth hat of the present invention, showing an exemplary attachment assembly. In this example, the attachment assembly comprises three strips 118, with each strip disposed between a pair of closely spaced-apart slits 119. In this example, the user may secure the cap to the belt by inserting the free end of the belt into one of the slits 119, passing it under the strip 118, and then pulling it out through the other slit 119 before buckling or otherwise fastening the belt.

Figure 13:
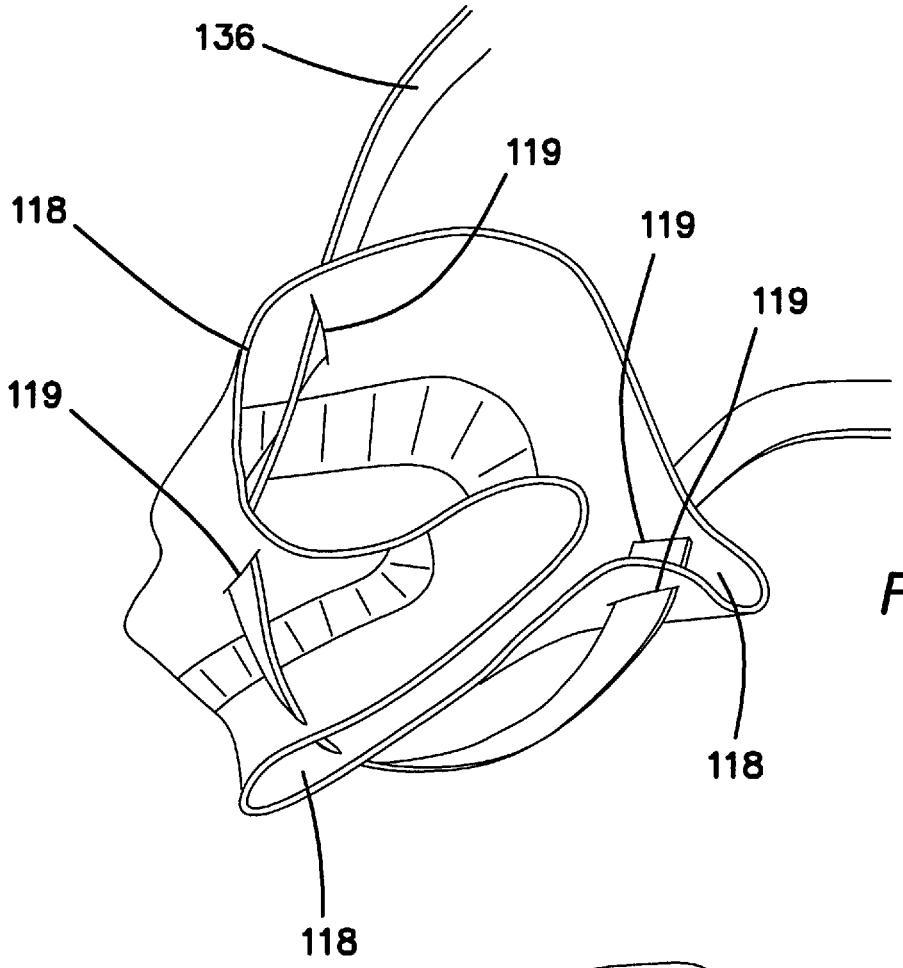
FIG. 13 is a view showing how a belt is threaded through the attachment assembly of the hat of FIG. 12.

FIG. 13 shows a way in which the hat of FIG. 12 may be attached to a waist belt 136 and folded before buckling or otherwise fastening the belt. The belt through each slit 119 and under each strip 118.

Figure 14:
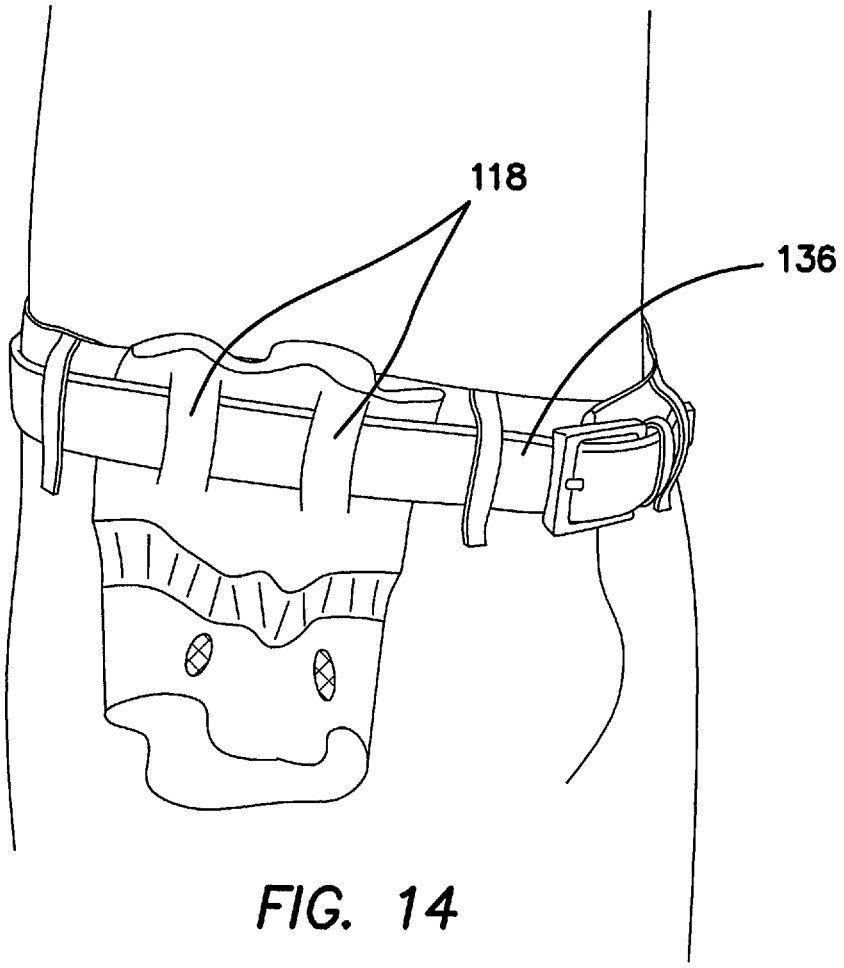
FIG. 14 is a view of the hat of FIG. 12 attached to a wearer's belt by the attachment assembly.

In this manner, when the belt 136 is cinched up and fastened, for example, as shown in FIG. 14, the hat is preferably carried in an inverted position, thereby providing a convenient pouch for keys, cell phone and other items.

Figure 16:
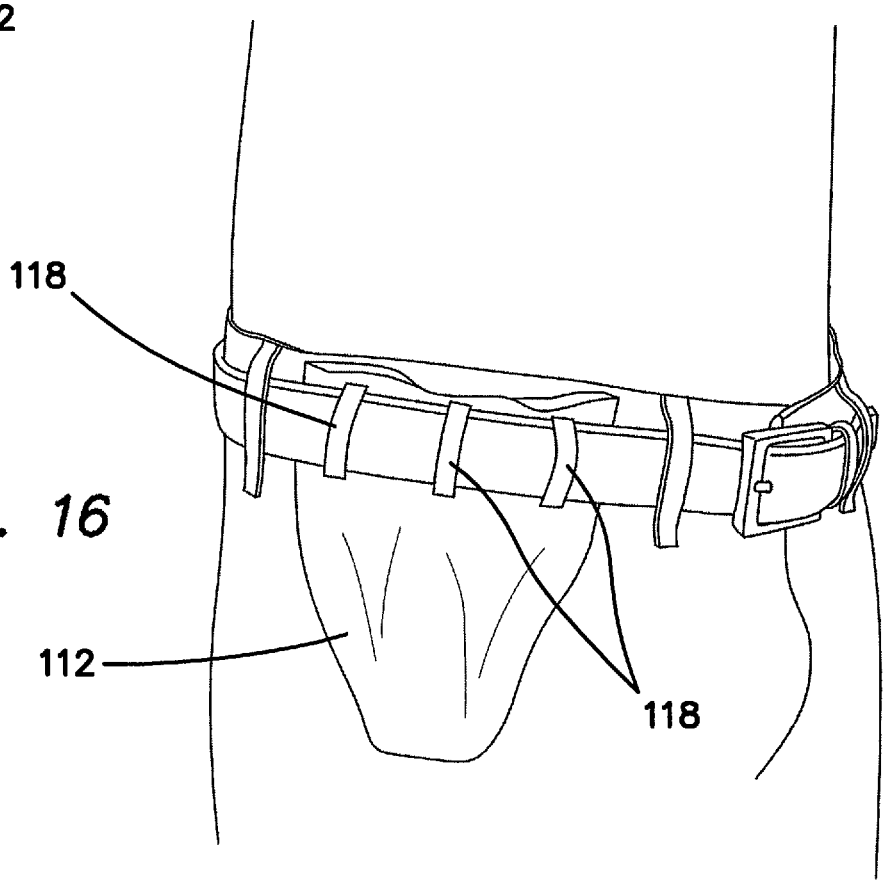
FIG. 16 is a view of the hat of FIG. 12 attached to a wearer's belt by the attachment assembly.
Figure 15:
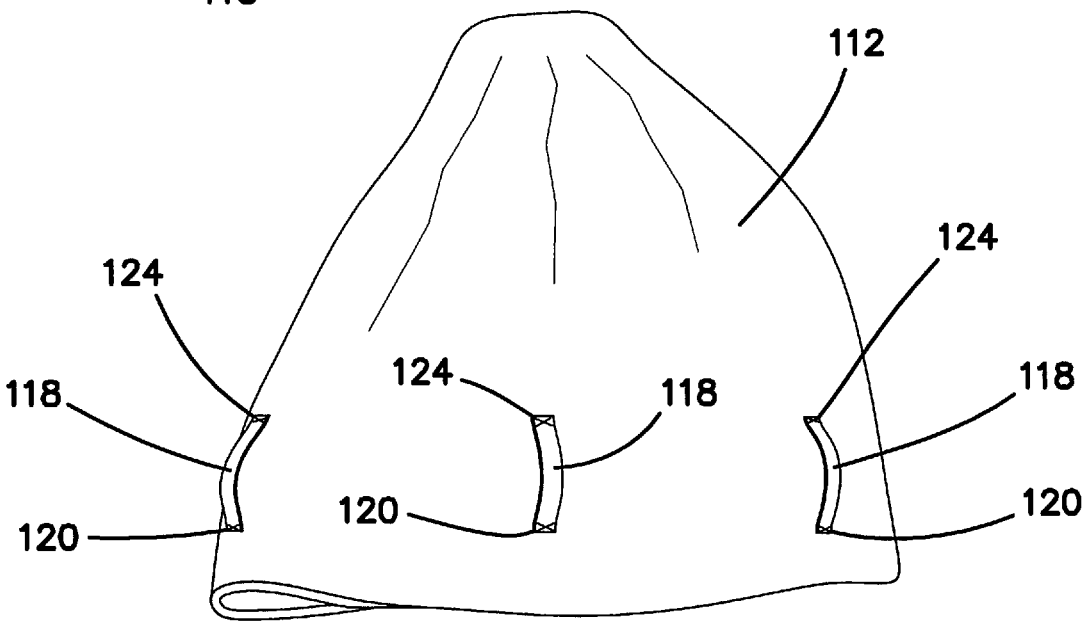
FIG. 15 is a side view of a woven watch cap or "beanie", having an attachment assembly joined along a side thereof.

Turning now to FIG. 15, a watch cap is depicted. In this example the watch cap comprises an attachment assembly having three strips 118, each strip having a first end 120 and second end 124 attached to the crown portion 112 of the cap. This cap can be fastened to a belt as shown in FIG. 16; in this configuration, a pouch may be formed as shown to hold items to be carried while the hat is folded; the side of the watch cap that is not joined to the belt by the attachment assembly (in FIG. 16, the inner portion of the watch cap behind the belt) may be held closed against the body by cinching the waist belt sufficiently tightly to prevent items carried in the pouch from spilling therefrom. Alternatively, the inner lower sides of the watch cap may comprise fastening elements, such as Although the hat shown, for example, in the exemplary embodiments of FIGS. 1-6 is shown as a baseball-type cap, while the hat shown in other exemplary embodiments (such as FIGS. 7, 8, 9A and 9B, in which the hat is shown as a flat cap), the principles of the instant invention are not intended to be restricted to use with any particular style of hat, but can be applied with equal effectiveness to a wide variety of hats, including bucket hats, newsboy hats, fisherman hats, and the like.

Similarly, various modifications could be made in the types of fasteners used, the materials used, and so forth, without departing from the spirit of the invention. The appended claims are therefore intended to cover and embrace any such modifications within the limits only of the true spirit and scope of the invention.

The invention claimed is:

1. A method for retaining a hat on a wearer's body comprising:

a) fastening a hat comprising an attachment assembly to a waist belt component, said waist belt component being separate from the hat comprising the attachment assembly; said fastening step comprising a step of:

i) inserting an end of said waist belt component through attachment assembly, the attachment assembly comprising a first flexible strip and a second flexible strip, each of said first flexible strip and said second flexible strip extending over an outside surface of the waist belt component threaded therethrough when said waist belt component is worn by said wearer, the first flexible strip and the second flexible strip each being joined to the exterior side of a crown portion or a brim portion of the hat, and allowing the first flexible strip and the second flexible strip to create a plurality of pleat folds in the hat when said hat and said waist belt are secured around the waist of a wearer thereby retaining said waist belt component with said hat attached thereto to the wearer's body.

2. The method of claim 1 wherein the attachment assembly includes at least two pairs of substantially parallel spaced-apart slits formed in the crown portion of the hat, or at least two pairs of substantially parallel spaced-apart slits formed in the brim portion of the hat; and said at least two pairs of substantially parallel spaced-apart slits defining each of said first flexible strip and said second flexible strip in the form of material located between one of the at least two pair of substantially parallel spaced-apart slits.

3. The method according to claim 1, wherein said first flexible strip and said second flexible strip have a length of at least about 1.75 inches long.

4. A method of securing a hat on a wearer's body when not being worn, comprising fastening a hat comprising an attachment assembly to a waist belt component, said waist belt component being separate from the hat comprising the attachment assembly, wherein said fastening step comprises a) inserting an end of said waist belt component through the attachment assembly, the attachment assembly comprising a first flexible strip and a second flexible strip, each of said first flexible strip and a second flexible strip extending over an outside surface of the waist belt component threaded therethrough when said waist belt component is worn by said wearer, said first flexible strip and said second flexible strip each being joined to the exterior side of a crown portion or a brim portion of the hat thereby allowing the first flexible strip and the second flexible strip to create a plurality of pleat folds in the hat when said hat and said waist belt are secured around the waist of a wearer, and b) securing said waist belt component around a waist of said wearer, thereby securing the hat on said wearer's body.

5. The method of claim 4 wherein the attachment assembly includes at least two pairs of substantially parallel spaced-apart slits formed in the crown portion of the hat, or at least two pairs of substantially parallel spaced-apart slits formed in the brim portion of the hat; and said at least two pairs of substantially parallel spaced-apart slits defining each of said first flexible strip and said second flexible strip in the form of material located between one of the at least two pair of substantially parallel spaced-apart slits.

* * * * *